United States Patent [19]

Johnson

[11] 4,240,377

[45] Dec. 23, 1980

[54] FLUIDIZED-BED COMPACT BOILER AND METHOD OF OPERATION

[76] Inventor: William B. Johnson, Gansett Point, Woods Hole, Cape Cod, Mass. 02543

[21] Appl. No.: 870,696

[22] Filed: Jan. 19, 1978

Related U.S. Application Data

[63] Continuation-in-part of Ser. No. 764,052, Jan. 31, 1977, abandoned.

[51] Int. Cl.[3] ..... F22B 1/02

[52] U.S. Cl. ..... 122/4 D; 110/245; 110/263; 431/7; 431/170

[58] Field of Search ..... 122/4 R, 4 D; 110/245, 110/263; 34/57 A; 165/104; 431/170, 7

[56] References Cited

U.S. PATENT DOCUMENTS

| | | | |
|---|---|---|---|
| 2,377,935 | 6/1945 | Gunness | 196/52 |
| 2,630,352 | 3/1953 | Degnen et al. | 302/52 |
| 2,729,428 | 1/1956 | Milmore | 257/6 |
| 2,818,049 | 12/1957 | Blaskowski | 122/4 |
| 3,119,379 | 1/1964 | Sweeney | 122/4 |
| 3,241,520 | 3/1966 | Wurster et al. | 118/62 |
| 3,306,236 | 2/1967 | Campbell | 110/8 |
| 3,387,590 | 6/1968 | Bishop | 122/4 |
| 3,397,657 | 8/1968 | Tada | 110/8 |
| 3,508,506 | 4/1970 | Bishop | 122/4 |
| 3,513,813 | 5/1970 | Towson et al. | 122/4 |
| 3,589,313 | 6/1971 | Smith | 110/8 |
| 3,702,595 | 11/1972 | Muirhead et al. | 110/8 R |
| 3,717,700 | 2/1973 | Robinson et al. | 423/244 |
| 3,859,963 | 1/1975 | Roberts et al. | 122/4 |
| 3,893,426 | 7/1975 | Bryers | 122/4 |
| 3,905,336 | 9/1975 | Gamble et al. | 122/4 D |
| 3,910,235 | 10/1975 | Highley | 122/4 |
| 3,921,544 | 11/1975 | Reese | 110/8 F |
| 3,970,011 | 7/1976 | Virr et al. | 110/8 F |
| 3,992,558 | 11/1976 | Smith-Johanssen et al. | 427/213 |

FOREIGN PATENT DOCUMENTS 1326651 8/1973 United Kingdom .

OTHER PUBLICATIONS

Genetti, et al., *Heat Transfer in a Dilute-Phase Fluidized Bed Tubular Heat Exchanger, Int. Chem. Engineering Symposium, Series No. 30, 1968.*

Yang, et al., *Recirculating Fluidized-Bed Reactor Data Utilizing a Two-Dimensional Cold Model,* AIChE Symposium Series, No. 141.

Horsler, et al., *High Pressure Fluidized Beds,* Chemical Engineering Process, vol. 65, No. 10, Oct. 1969.

Gopichand, et al., *Pneumatic Conveyance and Continuous Fludization of Solids,* Industrial & Engineering Chemistry, Vol. 51, No. 12, Dec. 1959.

K. D. Kiang et al., *Heat Transfer in Fast Fluidized Beds,* Jun. 1975.

Mickley and Trilling, *Heat Transfer Characteristics of Fluidized Beds,* Industrial and Engineering Chemistry, vol. 41, No. 6, 1949.

Farber et al., *Heat Transfer to Flowing Gas-Solids Mixture in a Circular Tube,* Industrial & Engineering Chemistry, vol. 49 No. 7 Jul. 1957.

Zabrodsky, S., *Compound Heat Exchange Between a High Temperature Gas-Fluidized Bed and a Solid Surface,* Int. J. Heat Mass Transfer vol. 16, 1973.

Koble, et al., *New Data for . . . Heat Transfer to Fluidized Solids,* Chemical Engineering, Sep. 1951.

Baskakov, et al., *Heat Transfer To Objects Immersed in Fluidized Beds,* Powder Technology, vol. 8, 1973.

Nack et al., *Fluidized-Bed Combustion Review,* Battelle, Columbus, Ohio, 1975.

Nelson, W. L., *Petroleum Refinery Engineering, McGraw-Hill Inc. 1949 pp. 692-694.*

*Primary Examiner*—Edward G. Favors

[57] ABSTRACT

A method and associated apparatus for carrying out fluidized bed combustion and transferring heat produced thereby to a boiler includes providing a fluidized bed of particulate matter and introducing fuel particles thereinto, causing a portion of the fluidized bed constituents to flow upwardly through a heat exchanger which is essentially free of any obstructions to said flow, and reintroducing the portion of fluidized bed constituents which flow through the heat exchanger, back into the fluidized bed. As preferably embodied, the portion of fluidized bed constituents flows into an inlet at the bottom of the heat exchanger from a quiescent zone adjacent the combustion bed and a gas having a combustible component is introduced into the heat exchanger. Advantageously, additional fuel particles are also introduced into the heat exchanger to flow upwardly therethrough. Also advantageously, the cross-sectional area of the flow path provided in the heat exchanger is proportioned to provide an essentially uniform temperature profile across the flowing particles at any position in the heat exchanger.

55 Claims, 6 Drawing Figures

FIG. 2
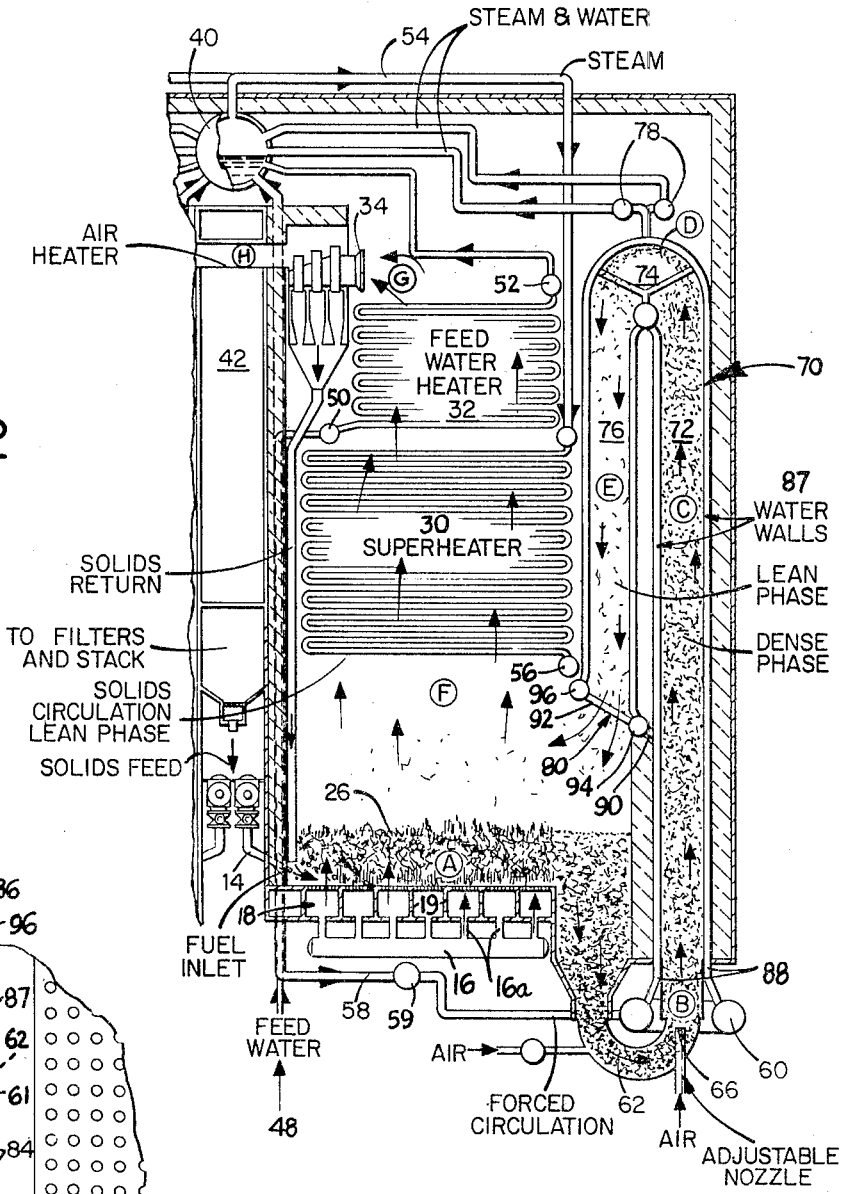
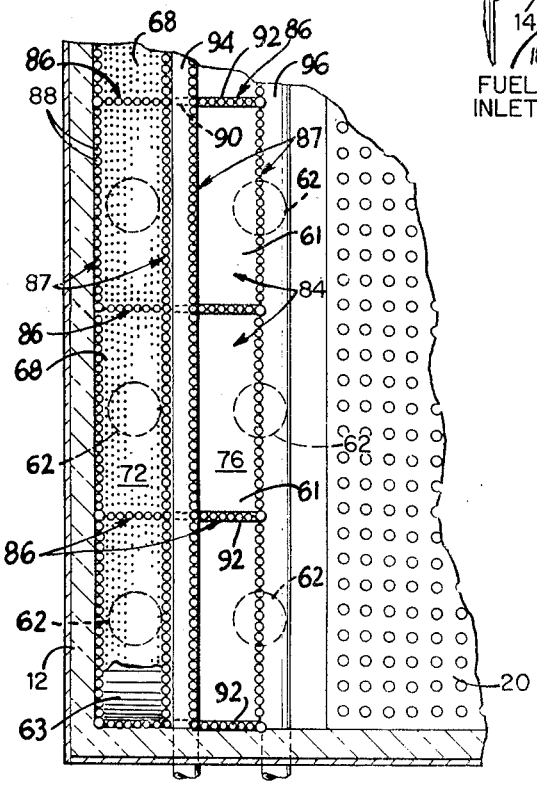
FIG. 3

FLUIDIZED-BED COMPACT BOILER AND METHOD OF OPERATION

CROSS REFERENCE TO RELATED APPLICATIONS

The present application is a continuation-in-part of my co-pending application, Ser. No. 764,052, filed Jan. 31, 1977 now abandoned.

BACKGROUND AND OBJECTS OF THE INVENTION

The present invention relates generally to so-called fluidized bed combustion and, more particularly, to certain new and useful improvements in fluidized bed boiler apparatuses and methods for carrying out and operating same.

Combustible materials, such as a variety of fossil fuels, have been combusted in fluidized bed apparatuses, such as boilers, to generate heat by passing a heat-exchange fluid, such as water, in a heat-exchange relationship through the fluidized bed to obtain steam from the water. Fluidized bed combustion is well-known and is and has been the subject of extensive development (see "Fluidized-Bed Combustion Review" by H. Nack et al., Batelle, Columbus, Ohio, presented at International Conference on Fluidization, June 1975, Asilomar, Calif., incorporated by reference herein).

Typically, a fluidized bed boiler has a combustion chamber in which a particulate fuel, such as coal, is introduced to a fluidized bed of particulate material by passing air through the bed to promote the combustion of the fuel. The fluidized bed generally includes inert particulate particles, and may also include dolomite, limestone or other materials which serve to absorb or to react with the sulfur or other undesirable additives in the fuel to be combusted. The fluidized bed is often quite shallow and has heat-exchange tubes immersed in the fluidized bed to effect heat transfer from the heated particles to the water passing through the heat exchange tubes. In some cases, additional tubes with water are placed in the space above the bed.

Fluidized bed combustion generally operates at temperatures of 1500° to 1700° F., which are milder conditions than those encountered in conventional nonfluidized bed boilers, and thus nitrous oxide gases are considerably reduced. Such fluidized bed boilers are quite useful, particularly with solid fuel, such as coal, since they eliminate the premixing of the air in the fuel and lead to lower temperature conditions, thus, eliminating slag deposits on the cooling surface, and at the same time providing for very high heat-transfer rate to the surface.

In the operation of various prior art fluidized bed combustion apparatuses, such as incinerators and boilers, a portion of the fluidized bed has been recirculated by various techniques to improve heat output or apparatus performance, such as, for example, the recirculation of a bed within an incinerator as set forth in U.S. Pat. No. 3,702,595, and the recirculation of a fluidized bed comprising a coal- and solid-absorbent material in a stacked fluidized bed arrangement, as set forth, for example, in U.S. Pat. No. 3,905,336, and the recirculation internally within a fluidized bed apparatus as, for example, in U.S. Pat. No. 3,910,235.

However, there are certain problems associated with known fluidized bed boilers and the pressure conditions under which they operate, particularly where heat exchange tubes are inserted into the fluidized bed. Such heat exchange tubes often obstruct the flow of the fluidized bed particles, present difficult support problems at the temperature conditions employed, and restrict fluidization of the bed by the creation of dead spots therein. Fluidization in such systems has been improved by increasing the air velocity through the bed of solids, but this creates a further problem in that the finer bed particles tend to be carried out of the fluidized bed. To prevent excess fluidized bed particle carryover, larger-size particles in the fluidized bed have been employed; that is, particles with an average particle size of about 500 microns, and typically 300 to 450 microns in size, in comparison to the usual average particle range of about 100 to 150 microns. The employment of larger particles, however, reduces the heat-transfer rate due to the reduced surface area per given weight of the larger-size particles, and also creates unsteady flow conditions in the bed, resulting in large bubble formations, thereby reducing the efficiency of contact and efficiency of combustion. Therefore, in most fluidized bed boilers, a compromise is employed wherein velocity, particle size, operating pressure and the use of the form, number and shape of the heat exchange tubes placed in the bed are balanced to arrive at a compromise on the heat efficiency desired in the particular boiler.

Another drawback of prior art fluidized bed boilers is the relatively low number of control points for enabling various parameters, such as temperature and particularly, operating capacity, to be controlled. In addition, current proposals for increasing overall capacity include stacking several fluidized beds over each other, while slumping some of the beds to control capacity. However, not only is such configuration severely limited by vertical dimension constraints but there will also be structural support restrictions, particularly in view of the operating temperatures, all of which serve to limit the practicality of this approach.

Another proposal involves passing fluidized bed particles to a chamber having heat exchange tubes positioned therein. However, the tubes tend to obstruct flow and, more importantly, a gas bubble-like layer builds up on the surface of the tubes rather than a continuous mixture of solids and gas, thereby substantially lowering heat transfer efficiency since much greater heat transfer is provided by solids contact than gas at the same temperature.

Furthermore, prior art devices are generally inacapable of utilizing the "Fines", or finely ground solid fuel (e.g., coal) particles, produced during the crushing operation. Thus, efficiency is further reduced to the extent the "Fines" are lost with the flue gas or are not used at all.

Accordingly, it is an object of the present invention to provide a new and improved fluidized bed boiler apparatus and method for carrying out and operating of same. Another object of the invention is to provide a new and improved fluidized bed boiler apparatus and method for carrying out and operating same, capable of relatively high efficiency heat transfer, yet operating at relatively low temperatures to limit production of nitrous oxide and enabling suitable reaction for removing $SO_2$.

It is also an object of the present invention to provide a new and improved fluidized bed boiler apparatus and method for carrying out and operating same, capable of relatively high heat transfer with no slagging of the ash.

It is an additional object of the invention to provide a new and improved fluidized bed boiler apparatus and method for carrying out and operating same, which enables finely ground solid fuel particles otherwise too small to burn in a fluidized combustion bed, to be completely combusted and the heat generated thereby to be efficiently utilized.

It is still another object of the instant invention to provide a new and improved fluidized bed boiler apparatus and method for carrying out and generating same, which includes a relatively large number of control points for enabling certain operating parameters to be controlled, particularly the operating capacity of steam generation.

It is also a further object of the invention to provide a new and improved fluidized bed boiler apparatus and method for carrying out and generating same, wherein particulate matter circulates in heat exchange means for increased heat transfer.

It is still an additional object of the invention to provide a new and improved fluidized bed boiler apparatus and method for carrying out and operating same, which enables control of the temperature of the fluidized bed.

Objects and advantages of the invention are set forth in part above and in part below. In addition, these and other objects and advantages of the invention will become apparent herefrom, or may be appreciated by practice with the invention, the same being realized and attained by means of the instrumentalities, combinations and methods pointed out in the appended claims. Accordingly, the present invention resides in the novel parts, constructions, arrangements, improvements, method and steps herein shown and described.

SUMMARY OF THE INVENTION

My invention relates to a fluidized bed combustion apparatus and the method of carrying out and operating same. In particular, my method and apparatus is directed to an improved, compact, fluidized bed boiler and the method of operation thereof, and more particularly to a fluidized bed boiler and its method of operation, which involves a high-solids recirculation system, providing for a compact boiler of high heat and combustion efficiency. My boiler and method of operation include the employment of a high-solids recirculation system of the fluidized bed constituents, while the fluidized bed particulate material, including unburned fuel therefrom, is moved in an upwardly and then optionally a downwardly flow-transfer path, the flow-transfer path being substantially free of any flow-transport obstructions therein.

Briefly described, the method and associated apparatus according to the present invention, for carrying out fluidized bed combustion and transferring the resultant heat to a heat transfer mechanism, includes providing a fluidized bed of particulate matter and introducing fuel particles into the fluidized bed, causing a portion of the constituents of the fluidized bed to flow into an upwardly through vertically extending heat exchange means which are separated from the fluidized combustion bed and which are substantially free of any obstruction to flow therein, and reintroducing the withdrawn portion of the fluidized bed constituents into the fluidized bed. Advantageously, the means causing transfer of the portion of the fluidized bed constituents to the heat exchange means comprises means for controlling the density of particulate transport flow through the heat exchanger and, advantageously, also include means for controlling the rate of particulate flow into the heat exchange means. As preferably embodied, the transfer causing means comprise a nozzle valve governing the inlet of the heat exchange means and adapted to introduce a gas which is at least partially combustible into the heat exchange means, at the bottom of the heat exchange means. Also, advantageously, the nozzle valve is further adapted to introduce additional fluidizable fuel into the heat exchange means. Also advantageously, additional heat exchange means, such as superheater for heated heat exchange fluid and/or feed water heater for heating heat exchange fluid for the heat exchange means, are positioned above the fluidized combustion bed.

Also, as preferably embodied, the portion of fluidized bed constituents flowing into and through the heat exchange means flows from a relatively quiescent area adjacent the fluidized combustion bed into the heat exchange means.

According to one aspect of the invention, a withdrawal duct couples the flow between the quiescent zone and the heat exchange means, and the inlet to the heat exchange means is controlled by the nozzle valve means which is adapted to vary the rate of solids flow through the inlet to the heat exchange means and introduce additional fuel along with the gas into the heat exchange means. Alternatively, the quiescent area is located directly adjacent the heat exchange inlet which is controlled by the nozzle valve means.

By the method and apparatus according to the invention, heated particulate matter from the fluidized bed and unreacted fuel particles, such as coal, are removed from the fluidized bed through the use of a pressure difference created externally of the bed which, preferably, does not have any heat-exchange cooling surface within it. Removal is accomplished through the introduction of air into the heat exchange device, at the bottom thereof, to provide a means for carrying the solids to establish a circulation flow rate and, advantageously, to provide additional air for combustion of unburned and/or additional fuel particels. The withdrawn fluidized bed materials are passed upwardly in a first vertical heat exchange chamber and, advantageously, downwardly in a second, return, heat exchange chamber, connected by an arch-contacting chamber, and discharged into the fluidized bed from the exit of the downward chamber, which is preferably positioned directly above the fluidized bed, with combustion of unburnt and/or additional fuel particles carried out in the heat exchange chambers.

According to another aspect of the invention, there is a minimum defined distance between the walls of the heat exchange chambers, so that, as heat is transferred and combustion proceeds, there is a substantially and generally uniform temperature profile maintained across the cross-sectional area at any given point in the heat exchange chambers. As the fluidized bed particles are moving upwardly in the first upward vertical chamber, the particles are in a denser phase than while moving downwardly in the second downward chamber. Thus, by maintaining a high-solids circulation rate through withdrawal of a high portion of the fluidized bed and passing the particles from the fluidized bed through an obstruction-free flow-transfer path, first in an upward vertical direction and then downwardly in a parallel direction, a relatively compact boiler may be provided and method of operation of same, with high controllable efficiency obtained.

Since there may be some tendency for the flue gas so discharged to carry fine solid particles upwardly out of the bed, the superheater and/or additional heat exchange means positioned above the bed, serve not only to capture additional heat but also to provide a particle-impingement barrier to knock the particles back into the bed in order to maintain efficient mixing of the cooled and heated particles. A small portion of finer particles which pass through the impingement barrier is collected by a particle-collection system, such as an overhead cyclone, and then is returned by a different recycle system directly to the fluidized bed.

Accordingly, it will be found that the objects and advantages specifically described herein are achieved by the invention as herein disclosed and claimed. Thus, for example, it will be found that a method and associated apparatus for carrying fluidized bed combustion and transferring heat produced thereby to a boiler may be made in accordance with the present invention, enabling substantially highly efficient utilization of the heat produced by the combustion-boiler apparatus.

It will be found that be separating the heat exchange means of the boiler section from the fluidized combustion bed and providing the heat exchange means substantially free of any obstructions to fluid flow therein, the combustion/boiler apparatus will provide relatively high efficiency heat transfer.

It will also be found that by providing means for controlling the density of transport flow through the heat exchange means, the operating temperature of the combustion section can be controlled to maintain a predetermined low level of nitrous oxide production and prevent any slagging.

By reintroducing particles which have circulated in the heat exchange means back into the fluidized bed, it will be found that the temperature within the fluidized bed is controllable due to the intimate mixing of the cooled reintroduced particles with the particles being heated by combustion of the fuel.

In addition, by providing a vertically extending heat exchanger adapted to permit upward flow of a portion of the fluidized combustion bed, it will be found that the relatively low density of particulate matter with a high percentage of voids, about 95%, within the heat exchanger enables a portion of the heat associated with red hot particles to be transferred to the heat exchanger by radiation, thereby increasing the amount of heat transferred to the boiler section.

By introducing additional fuel and combustible gas into the heat exchange device, it will be found that otherwise unusable fuel particles can be efficiently burned in accordance with the present invention. In addition, by providing such combustion within the heat exchange means according to the present invention, additional heat may be transferred thereto by radiation from the burning of the additional fuel. Moreover, the burning additional fuel traveling through the heat exchanger helps provide a substantially uniform temperature throughout the flow path of the heat exchanger, i.e., from inlet to exit.

It will further be found that by providing a nozzle valve governing the inlet of the heat exchanger and gas inlets in both the heat exchanger and the withdrawal duct, a relatively large number of control points are provided for maintaining substantial control over the operational parameters of the system. Also, by separating the walls of the heat exchange means by a distance of between about one-half to about four feet, it will be found that an essentially uniform temperature profile will be provided in the heat exchange device across the flow path at any vertical position therein.

By providing additional heat exchange means above the fluidized combustion bed, it will be found that not only is heat associated with escaping flue gases transferred to the heat exchange fluid in the additional heat exchange means, but also lighter fuel particles tending to escape with flue gases will impinge on the additional heat exchange devices to be prevented from escaping combustion.

My invention will be described for the purpose of illustration only in connection with my preferred and specific embodiments. However, as will be recognized by those persons skilled in the art to which this invention is directed, various changes and modifications may be made to my illustrated fluidized bed combustion apparatus and method of operation thereof without departing from the spirit and scope of the invention covered thereby. Further and in particular, in defining the high-solids recirculation system of my apparatus and its method, the terminology "transport flow" shall mean that flow which operates above the choking velocity; that is, the minimum gas velocity required for vertical flow known in the art and as set forth more particularly in "Fluidization Engineering", Daizo, Kunii and Octave, Levenspiel, pages 385–387, published by John Wiley & Sons, Inc., 1969, hereby incorporated by reference.

BRIEF DESCRIPTION OF THE DRAWINGS

FIG. 2 is a partial, generally schematic view of the boiler of FIG. 1 illustrating the high-solids recirculation system and solids flow path according to the present invention.

FIG. 3 is an enlarged, fragmentary, cross-sectional view along lines 3—3 of the apparatus shown in FIG. 1.

DETAILED DESCRIPTION OF PREFERRED EMBODIMENTS

Figure 1:
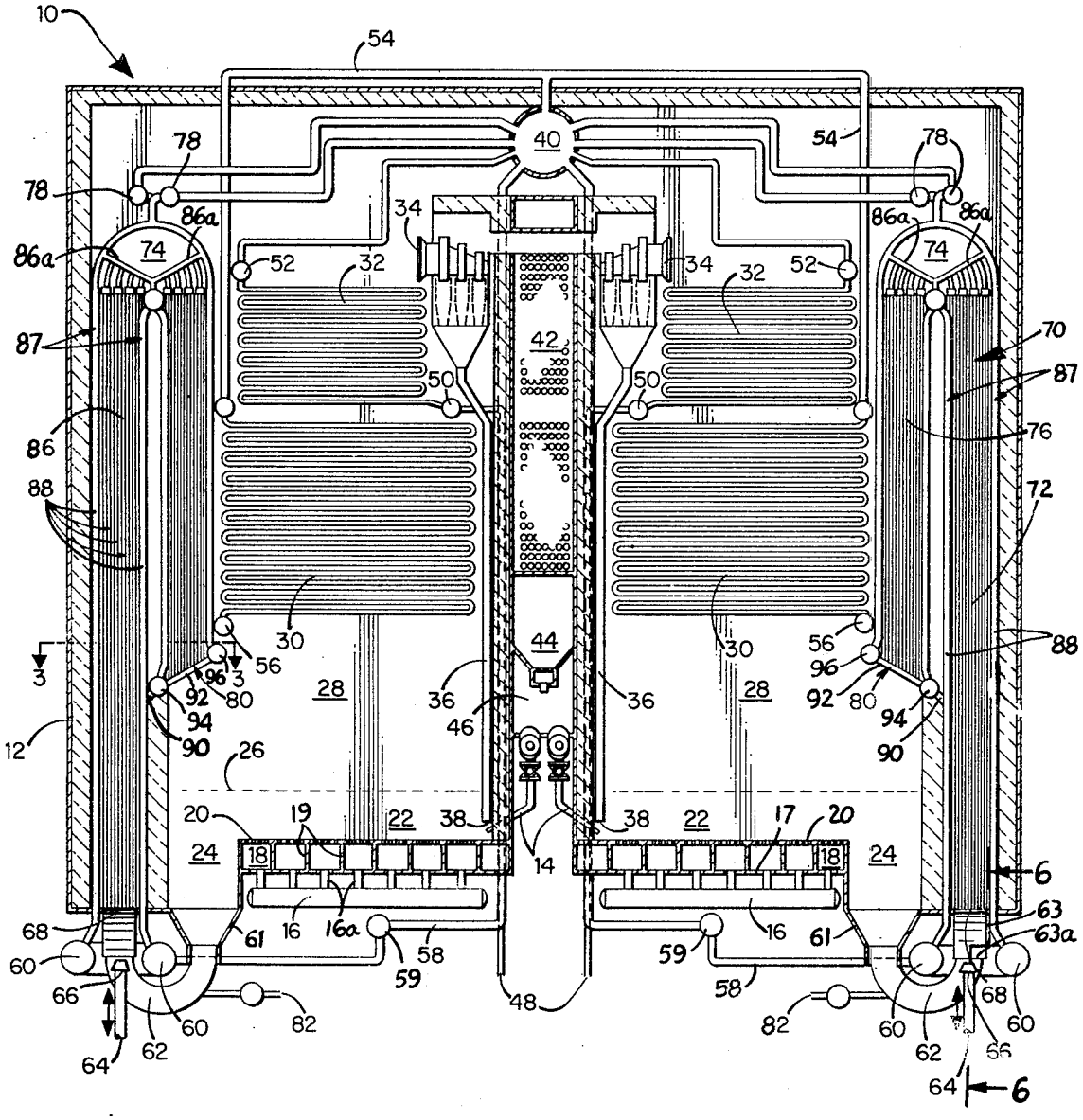
FIG. 1 is a representational, cross-sectional, elevation view of a fluidized bed double-boiler apparatus according to the present invention.

Referring now more particularly to the embodiments of the invention illustrated in the accompanying drawings, wherein like reference characters refer to like parts throughout the various views, there is shown in FIGS. 1 and 2, an embodiment of a fluidized bed double boiler (indicated generally at 10), having boiler or vessel walls 12, with a fuel inlet 14 which includes means for the introduction of a fuel. Fuel inlet device 14 may include any conventional feeder mechanism for injecting fuels such as a fossil fuel like fuel oil or a particulate fuel, such as coal particles, or any combination thereof. Thus, for example, fuel inlet 14 may include a screw feeder for introducing particulate coal or, preferably, a spreader stoker which throws the particles for distribution over the entire fluidized bed.

Boiler 10 also includes air inlet 16 for the introduction of a fluidizing gas having a combustible component (such as an oxygen-containing gas, preferably air), under pressure, coupled to the combustion chamber for fluidizing the constituents making up the fluidized bed. To this end, boiler 10 includes a column chamber 18 formed by floor plate 17, partition members (preferably solid) 19 extending upwardly therefrom and a perforated distributor plate 20 supported by partition members 19 to form a plurality of air dispersion chambers (unnumbered). Distributor plate 20 is here shown extended across a major part of the lower cross-section of the boiler, and may be tilted or sloped at one end, as explained more fully below.

The fluidizing gas is introduced from inlet 16 into column chamber 18 (through inlet conduits 16*a*, each leading to an air dispersion chamber) for dispersion into the fluidized bed bed combustion chamber (indicated generally at 22) by dispersion plate 20 to fluidize the combustion bed constituents. As here embodied, the fluidized bed may include an inert refractory material, such as sand, and, preferably, a material which absorbs or reacts with undesirable constituents (particularly $SO_2$) in the fuel, such as dolomite or limestone particles, or any combination of such constituents, with solid particulate or other combustible fuel, such as coal, tar sands, natural gas, etc. introduced therein to form a fluidized combustion bed of particulate matter in the fluidized bed combustion chamber 22.

In the preferred embodiment described, the fluidized bed combustion chamber 22 does not have any heat exchange tubes therein, although such tubes may be inserted into the bed if desired in order to, for example, cool bed 22. According to one aspect of the invention the fluidized bed has, at the one end, a quiescent section 24 which is not disturbed by the introduction of the fluidizing gas through the distributor plate 20, like that portion of bed constituents directly above distributor plate 20, as schematically illustrated in FIG. 2. In addition, an interfacial surface, 26, is defined between the fluidized portion of the bed and disengaging chamber 28.

Advantageously, disengaging chamber 28 is positioned directly above the bed 22, with heat exchange tubes, or superheater tubes, 30 positioned in chamber 28 in a radiant heat exchange relationship. Superheater tubes 30 not only contain steam to be heated by the rising gases and particles from bed 26, but they also serve as an impingement barrier to the upward movement of fine particles carried by the gases. Also advantageously, the boiler 10 includes upper heat exchange tubes 32, or feed-water heaters, also positioned in chamber 28 above both the combustion bed and superheaters 30. Tubes 32 typically contain water to be heated in a heat exchange relationship with the rising gases from bed 22 as explained more fully below, and, like superheaters 30, provide an additional impingement barrier to upwardly moving fine particles.

A gas-solids separator 34, such as a gas-solids cyclone-type separator, is positioned in disengaging chamber 28, above tubes 30 and 32, to receive very fine upwardly flowing solid particles which pass these impingement barriers. Advantageously, gas-solids separator 34 directs the finely-divided separated solids so captured through solids return line 36 to an exit 38, whereby the solids are returned directly to the fluidized bed 22. Further advantageously, the exit of the solids return line 36 is positioned approximately adjacent to the fuel inlet 14, to aid in preheating the fuel to be introduced into the fluidized bed 22.

Boiler 10 also includes a steam-water-separator boiler drum 40, a flue-gas air heater 42 which receives flue gas from the separator 34 for heating air introduced through inlet 16, and a flue-gas exit 44, coupled thereto and leading to the stack and filters (not shown). Exit 44 preferably includes an air slide 46 to remove fly ash through an ash-discharge hopper (not shown) before exhausting the flue gases. The boiler also includes inlet 48 for introducing heat exchange fluid, such as feed water, to the boiler system. Inlet 48 is coupled to entrance header 50 of feedwater heater 32 having exit header 52 therefrom, leading to drum 40. Entrance 54 of superheater 30 is coupled to drum 40 and has exit header 56 therefrom, which is the exit for the superheated steam from the system and leads, for example, to a steam turbine. In addition, heat exchange fluid line 58 extends from the boiler drum 40 to a mud drum 60, all as will be explained more fully below.

Figure 6:
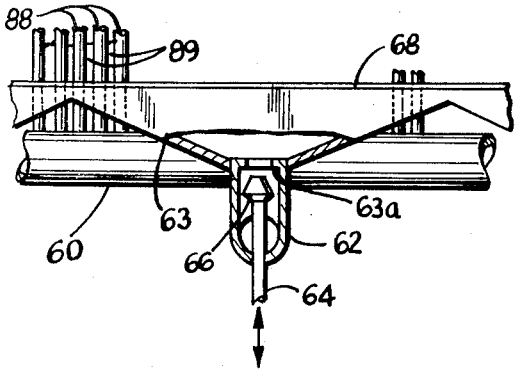
FIG. 6 is a sectional view taken along section 6—6 of FIG. 1.

As here embodied, the high-solids recirculation system according to the invention comprises a withdrawal duct 62 which includes a U-bend feed withdrawal duct, the entrance of which is in direct communication with the quiescent section 24 of the fluidized bed, as by funnel-shaped inlet member 61, so that the particulate material may be drawn from the fluidized bed into the withdrawal duct directly. Withdrawal duct 62 also includes funnel-shaped outlet member 63 (shown in FIG. 6) for introducing fluidized particles into the boiler section (indicated generally at 70), as described more fully below. Advantageously, withdrawal duct 62 is of generally reduced cross-sectional area relative to the cross-sectional area (as defined in the plane perpendicular to the plane of FIGS. 1 and 2) of quiescent zone 24 for enabling substantial control over the circulatory flow of fluidized particles between the combustion section and the boiler section.

Thus, duct 62 may have a generally circular cross-sectional area while inlet member 61 is tapered both as indicated in FIG. 2 and in the direction perpendicular thereto to increase the density of fluidized particulate matter leaving quiescent zone 24. Outlet 63 is provided with a reverse taper in the upward flow direction to distribute flow over perforated distributor plate 68 which is positioned at the bottom of the boiler section. However, as here embodied, the upward reverse taper is only in the directions perpendicular to the plane of FIG. 2, since the boiler section channel can be about as wide as the diameter of duct 62.

As preferably embodied, boiler 10 also includes inlet 64 for the introduction of a gas having a combustible component, such as air, or if desired a mixture of air and fuel, such as natural gas or other fuel, as will be explained more fully below. In addition, an adjustable nozzle 66, adjustable within the withdrawal duct 62, is operable within duct 62 to control the rate of solids circulation in the heat exchange section by vertical movement of the nozzle 66 in combination with varying the flow of gas through inlet 64. Advantageously, additional fuel may be introduced along with the gas through inlet 64 or through a separate fuel inlet.

As preferably embodied, the nozzle 66 and air inlet 64 are formed as integral adjustable nozzle valve which comprises a plug type valve or an injection type cone valve, such as described in U.S. Pat. No. 2,630,352, of which I am a co-inventor and which is hereby incorporated by reference herein. Accordingly, the valve includes a hollow central tube, enabling the introduction of the gas and additional fuel therethrough, as well as a head portion controlling the size of the opening (63*a*) leading into upward chamber 72. Alternatively, a slide valve could be used instead of nozzle valve 66.

Boiler section 70 comprises vertical, upward flow chamber 72, an arched roof chamber 74 and a downward flow chamber 76. Flow chambers 72 and 76 are constructed of standard boiler web walls or furnace wall panels (indicated generallay at 87) comprising a series of heat exchange tubes 88 joined together by webs 89. As preferably embodied, a series of partition walls 86 formed of tubes 88 are positioned at spaced intervals between and perpendicular to the walls 87 of tubes 88 to define a series of generally parallel slots, or heat exchange passages, 84, between the walls of each chamber for the transport flow of the particulate material. FIG. 1 shows the schematic view of the partitioned, walled chambers. Advantageously, the arched roof of the chamber 74 is also constructed of the joined web-type heat exchange panels 87, and serves as the heat-exchange fluid connection between the respective web panels of the chambers 72 and 76. However, as indicated in FIG. 1, the portion of each partition 86 residing within arched chamber 74 is formed with conduits 86*a* leading to a tube 88 in the wall portion thereof, thereby defining only a small section which does not include heat exchange tubes.

Accordingly, from the heat exchange fluid line 58, heat exchange fluid passes through one of mud drums 60 (adapted to separate solids from the fluid circulating through tubes 88), then through the tubes 88 forming the walls 87 of chambers 72, 74 and 76 to one of the headers 78 which carries the heated fluid to the boiler drum 40. To this end, a mud drum 60 extends under all the parallel extending heat exchange tubes 88 in each wall 87, in fluid communication therewith, to feed heat exchange fluid thereinto. In addition, cross-over connectors 90 and 92 provide fluid communication, respectively, between the tubes 88 of the inner wall 87 of upward chamber 72 and the inner wall of downward chamber 76, and between the inner and outer walls of chamber 76 so that the heat exchange fluid flows upwardly in chambers 72 and 76 and into separator drum 40 through one of the headers 78. It will be understood that two headers 78 may be used to prevent too many holes (to allow entry for each tube 88 coupled thereto) therein to weaken the header. However, one large header 78 may be used to accommodate all the tubes without risking structural weaknesses.

Although a natural circulation of heat exchange fluid will occur through the conduits described immediately above, pumps 59 may be placed in fluid line 58 to assist in the flow, particularly during start-up. In addition, cross-over members 90 (which are aligned with and equal in number to the partitions 86) advantageously lead into header 94 at the bottom of and coupled to all the tubes 88 of the liner wall 87 of chamber 76, and, crossovers 92 (also aligned with and equal in number to partitions 86) lead from header 94 to header 96 at the bottom of and coupled to all the tubes 88 of outer wall 87 of chamber 76.

Figure 4:
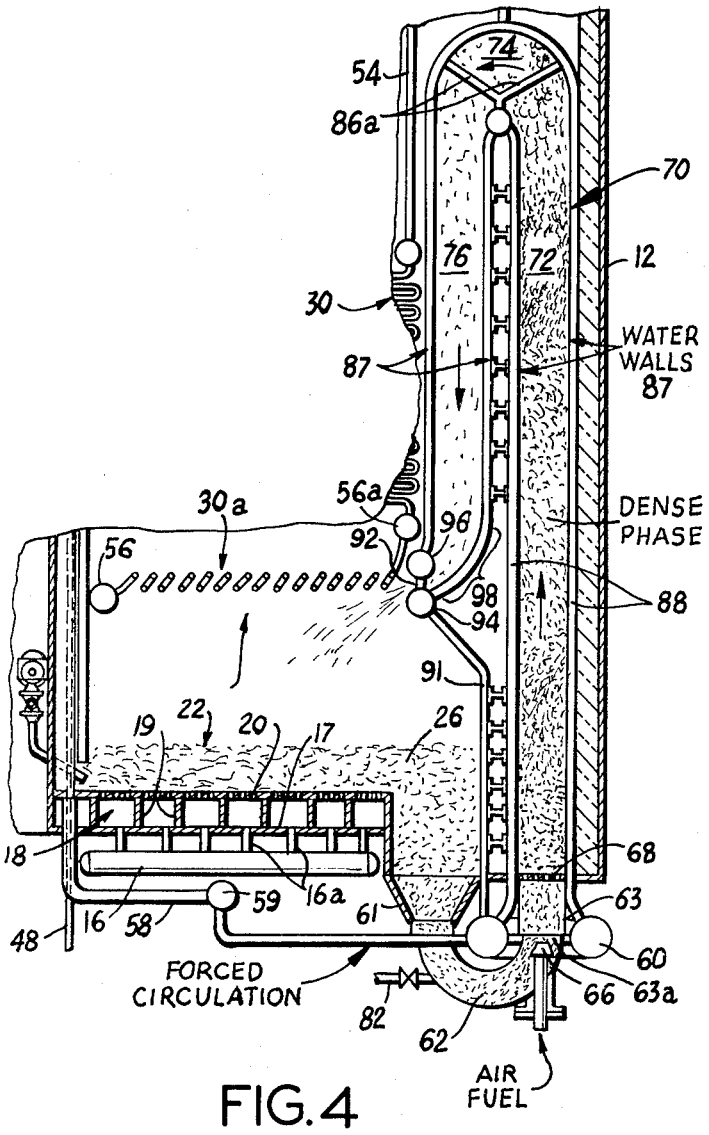
FIG. 4 is a partial elevation view generally similar to that of FIG. 2, showing another aspect of the present invention.

The flow chamber 76 has a solids exit (indicated generally at 80) which discharges into the disengaging chamber 28, preferably directly above the fluidized bed 22, whereby the articles circulating within the withdrawal duct and slotted chambers 72, 74 and 76 may be discharged downwardly into and returned to the fluidized bed 22. Although the exit 80 shown in FIGS. 1 an 2 is shown positioned over quiescent zone 24, it will be understood that the particles in the exiting flow will tend to fall into bed 22 due to the intermixing of exiting flow with the gases rising from bed 22 and quiescent zone 24. However, as preferably embodied, exit 80 is positioned generally over bed 22 as indicated in FIG. 4.

As the various gases (i.e., the flue gases flowing in and the gas introduced into boiler section 70) and the particulate matter travel through the chambers 72, 74 and 76, particulate matter adjacent the surface of partition walls 86 will tend to circulate thereat due to the combined effect of the drag (i.e., friction) from the wall and the downward pull of gravity as well as the upward "push" of the gases. Thus, for example, the particulate matter may travel at an average velocity of about 7 ft/sec while the superficialvelocity of the gas may be at about twice, or more, that rate, thereby providing an efficient heat transfer from the fluidized combustion constituents to the heat exchanger tubes 88.

As preferably embodied, the withdrawal duct 62 also includes a fluidizing or an aeration air inlet 82 which aids in fluidizing (i.e., controlling the density of) the solid particulate material from the fluidized bed 22 by providing an entry for air flow into the withdrawal duct 62. It will be understood that inlet 82 provides an additional control point for enabling control of the density of the fluidized particulate material flowing into flow chamber 72.

Advantageously, in order to facilitate flow of fluidized bed constituents towards the quiescent zone 24 and thence into boiler 70, distributor plate 20 may be sloped a slight degree downwardly toward quiescent zone 24 particularly for relatively shallow beds (less than about 6 inches). Alternatively, distributor plate 20 may be level but formed with one or more grooves which slope downwardly towards quiescent zone 24. However, it will be understood that for most moderately deep beds (i.e. about 6 inches or more), the top surface of the bed will find its own gradient, or angle of repose towards quiescent zone 24 where distributor plate 20 is not sloped.

FIG. 3 shows in more detail the plan view of the high-solids concentration recirculation system wherein the upward (72) and downwardd (76) flow-transfer chambers comprise a plurality of heat exchange passages 84, each being about two feet thick (i.e., the distance between opposite walls 87) and about six feet wide (i.e., the spacing between partition walls 86) to effect a heat exchange relationship between the combustion flue gases and particulate matter moving upwardly in chamber 72, laterally in the chamber 74 and downwardly in chamber 76. The upward, top and downward flow-transfer path and chambers are shown and illustrated as a plurality of parallel aligned, flow passages. However, it will be understood that chambers of various dimensions, shapes and sizes may be employed, so long as such flow-transfer path in the chambers are free of any flow obstructions therein.

Also, advantageously and according to another aspect of the invention, chambers 84 should not haved a cross-sectional area so large as to allow an extensive heat gradient across the cross-section of a heat exchange passage (i.e., between the center of the passage and the adjacent wall) at any point in chambers 72, 74 or 76. Accordingly, the cross-sectional area should be limited to permit the maintenance of a substantially uniform high temperature profile across the cross-section (i.e., the thickness) at any given point in each chamber during the high-solids circulation flow. Cross-sectional areas of too large a dimensions will prevent the maintenance of a substantially uniform temperature profile, because there will be insufficient contact of the fluidized particles in the center section of the flow-transfer path to permit efficient heat transfer.

Accordingly, as here embodied, the thickness of each heat exchange passage 84 is at least about one-half foot (½') but no more than about four feet (4') throughout the three chamber sections, 72, 74 and 76. In addition, the width of each passage 84 is no more than about six feet (6'). It will be understood that the six foot dimension on the passage width is normally limited to permit uniform distribution of the flowing medium from the exit of duct 62 to plate 68 (via funnel outlet 63) which, in turn, distributes the flowing particles and gases uniformly throughout the heat exchanged passages 84 for optimizing heat transfer.

It will also be understood that the limitation on the thickness of each passage 84 is particularly useful since a thickness of less than about one-half foot will not enable particulate matter to circulate adjacent the heat exchange walls 86, as the gases flowing through the open channels will tend to push all the particles through the boiler section and overcome the combined gravitational and frictional effect at the walls. Similarly, a width greater than about four feet will enable the particulate matter adjacent the heat exchange walls to escape the push of the gas flowing through flow chambers 72, 74 and 76, thereby to reduce the efficiency of total heat transfer. Also, as a practical matter, smaller widths will not enable a person to enter the slots 84 to effect repair of a broken tube 88, thereby requiring whole sections to be cut away. It will be also be understood that the maintenance of the uniform temperature profile is particularly advantageous since the transport flow close to the heat exchanges surfaces will be at a temperature only slightly lower than that at the center of the heat exchange passages, allowing greater heat transfer at the surfaces and, therefore, greater efficiency.

In may apparatus and method, reliance is placed on efficient heat exchange during the transport flow of the fluidized bed particulate matter withdrawn from the withdrawal duct 62 and introduced for flow transfer through the upward, top and downward chambers 72, 74 and 76, respectively. In the fluidized bed combustion chamber 22, there is no transport-flow movement of the particles therein, which particles comprise the fluidizing air or combustible gas, unburnt or burning fuel particles, as well as optionally inert refractory particle and absorbent-type particles. In my high-solids recirculation flow system, there is a continual flow-transfer condition in the chambers 72, 74 and 76. My boiler has been illustrated in its preferred form, showing an arch chamber and a downward chamber; however, such chambers are not essential, although a preferred embodiment of my boiler.

Advantageously, combustion occurs in boiler section 70 due to the burning of unburnt fuel which may be included with the portion of fluidized bed consitituents circulating therethrough and the additional fuel introduced thereinto, by virtue of the additional gas introduced through air inlet 64 and/or air inlet 82. As preferably embodied, the solid fuel added to section 70 is normally in the form of relatively small particles to permit rapid combustion in the solids circulation system. The addition of this smaller size solid fuel is an advantage of the present invention, in that fines produced by the grinding of the solid fuel may be efficiently combusted in the boiler system and heat generated thereby efficiently transferred to the heat exchange means because of the greater surface area per unit mass as compared with the larger particles. It will be understood that these fine particles are not normally used in the present fluidized bed boilers because they tend to be blown out of the bed complete combustion takes place. In addition, the burning particles traveling through the boiler 70 tend to make a more uniform temperature throughout the boiler—i.e., from inlet at 68 to exit 80—while they radiate heat to the heat exchanger walls to transfer additional heat.

In the embodiment described, heat exchange tubes or means are not shown disposed in the fluidized bed combustion chamber 22, since, in the preferred embodiment, this permits the firing up more rapidly of my boiler. My boiler may be fired up without circulation, with the solids heating up quickly without loss of heat through cooling tubes inserted into the fluidized bed.

My boiler 10 has numerous advantages in addition to enabling rapid start up or firing of the boiler. My boiler permits the controlled rate of circulation of the fluidized bed solids in a flow-transfer condition throughout the recirculation system by merely varying the adjustable nozzle valve 66 which, thereby, controls the rate of heat transfer to the partition walls and tubes 88 in the boiler 70, which permits rapid turndown or increase in boiler capacity. This control of heat-transfer rate cannot be easily accomplished in fixed fluidized bed heat exchange boilers, since adjustment must be made by stopping the flow of air to sections of the fluidized bed, thereby causing slumping of the bed.

In addition, the height of known fluidized bed combustion boilers is normally limited due to pressure drop considerations, thereby restricting the amount of cooling surface which may be immersed within the bed. However, no such restriction exists in the boiler accordings to the present invention, since the extent of cooling surface exposed to the heat transfer medium can be varied by changing circulation velocity and solids concentration in the circulating system without increasing pressure drop through the system. The pressure drop throughout high-solids circulation system 70 is no greater than the pressure drop through the fluidized bed 22 and the static head of fluidized particles in the quiescent section 24 is greater than the pressure drop through the solid circulation system, thus providing the pressure gradient necessary to cause the desired circulating rate.

In my boiler, a much greater range of particulate particles sizes may be employed, with the smaller-particle range particularly preferred due to the greater surface area and more efficient and higher heat-transfer rate accomplished thereby, while where dolomite, limestone and other absorbent or reactant materials are employed, a smaller-particle size is more desirable as to effect the reaction rate with fuel contaminants. Typical particle sizes may range from as low as about 40 microns to 450 microns, and in a typical fluidized bed, often range from about 250 to 450 microns, while my boiler may operate efficiently and preferably at the range of from about 40 to 150 microns for mean particle size, which effects high heat-transfer rates. It will be understood that exhausted, or completely reacted, active particles will be withdrawn with the ash particles and fresh actived particles furnished along with fresh fuel.

My boiler also permits a very high heat transfer efficiency by employing heat exchange means essentially free of flow obstructions and, advantageous, providing a substantially uniform temperature profile therein, while the gas is being combusted during transport flow through the recirculation system. For example, where the slotted chamber has a dimension of six by two feet, the temperature profile, or difference, will be about 10° F. or less between the center of the passageway and the particles close to the wall surface, where the wall surface would be about 500° F. and the operating temperature would be about 1500° to 1700° F. This is due to the high degree of solids circulating along the wall by frictional resistance and gravitational forces opposing the upflow of the carrying gases.

In operation, my boiler is started up typically by the employment of an extraneous-type fuel, such as natural gas or light fuel, injected into the bed in order to heat up quickly the inert particulate solids in the fluidized bed 22, while air is introduced into the air inlet 16 through the plenum chamber 18 and the distributor plate 20 to form a heated fluidized bed combustion chamber 22. The corresponding fluidized bed dimensions for each six-by-two foot heat exchange passage 84 in the boiler section may have a size of from about six feet in thickness (corresponding to the width of the passage 84) by fourteen feet wide (the distance from inlet 14 to quiescent zone 24) and about two feet deep. However, the bed size and depth may, of course, vary, depending upon the boiler. The fluidized bed particles may have a density of approximately 35 to 75 pounds per cubic foot or generally about 50 pounds per cubic foot, with the pressure drop in the boiler at about 1 pound per square inch and the air (preheated by air heater 42 to about 750° F.) introduced into the air inlet 16 about 1 pound per square inch above atmospheric pressure.

Once the boiler operation is commenced, air (also preheated by air heater 42) is introduced through air inlet 82 at approximately 1½ pounds per square inch above atmospheric pressure to fluidize the particulate material from the quiescent zone 24 and to create a flow of the particles from quiescent portion 24 through the U-bend withdrawal duct 62, due to the pressure difference. Additional air (also preheated by heater 42) is also introduced through air inlet 64 through adjustable nozzle valve 66 and the nozzle valve positioned so as to permit a flow-transfer condition for the particulate material introduced into the withdrawal duct 62.

As described above, combustion occurs during the upward movement transport flow, with heat transferred to all the heat exchange tubes 88. The particulate material moves upwardly to the top chamber 74, laterally therethrough and then downwardly through chamber 76 where it enters a lean-density phase through gravity-acceleration forces, and then is discharged from exit 80 into the disengaging chamber 28. A majority of the particles are returned to the fluidized bed for recirculation, with the pressure in the disengaging chamber typically being about ¼ to ½ pound per square inch over atmospheric pressure. The particles returned to the fluidized bed 22 are then recycled back into the high-solids recirculation system. Rapid circulation, and, therefore, control of the heat exchange rate and heat transfer, is permitted through the positioning of the adjustable nozzle valve and the amount of air flow introduced to control transport flow; that is, the pressure drop created in the circulation system.

The majority of the particulate material discharged into the disengaging chamber 28, drops into the fluidized bed 22, while finely-divided particles move upwardly and strike superheater 30 or feed water heater 32 as impingement barriers, and, therefore, drop back to the fluidized bed. Much finer-divided particles move upwardly through the feed-water heater 32 where they are collected by gas-solids cyclone 34 and are returned through the solids return line 36 to the fluidized bed through discharge inlet 38, where they preheat the fuel to be introduced into the bed 22 by inlet 14. The flue gases pass through the air heater 42 and flue gas exit 44, after which they are discharged through the filter and stack.

The heat exchange fluid, initially water (as, for example, condensed steam from a steam turbine generator or other steam operated device coupled to boiler fluid exit 56), introduced through inlet 48 flows through preheater 32 via inlet 50 and thence into drum 40. Heated water from drum 40 flows through inlet 58 to mud drums 60, up through the numerous heat exchange tubes 88 and back into drum 40 generally as a mixture of water and steam. Steam from drum 40 flows through inlet 54 to superheater 30 and thence, via outlet 56 to a steam turbine or other steam operated device.

The flow-transfer high-solids circulation system is illustrated schematically in FIG. 2 in which various sections of my boiler have been designated with alphabetical characters. As a typical example of an improved boiler, the boiler drum 40 has a steam pressure of 1000 psi and the boiler is rated at a rate of about 50,000 pounds of steam (at about 1000° F.) per hour per 2′×6′ heat exchange chamber 84, having a vertical upflow length of about 30 feet (between distributor plate 68 and arch section 74) and a vertical downward flow length of about 18 feet (between arch section 74 and exit 80). Circulation of the entire bed is at the rate of 20 pounds of solids circulated per pound of steam generated, with the solids total residence time in the system ranging from about 5 to 60 seconds. The heat-transfer, the solids-concentration density and the superficial gas velocity are shown more particularly in this boiler in the following table.

TABLE I

Boiler with Fluidized Bed
Mean Particle Diameter 150 Microns

| Area (Fig. 2) | Heat-Transfer Rate Btu/hr/Ft$^2$/°F. | Solids-Concentration Density Lbs/Ft$^3$ | Superficial Gas Velocity (V) Feet/sec |
|---|---|---|---|
| A | | 50 | |
| B | | 1.6 | |
| C | 50 | 3.4 | 15 |
| D | 68 | 4.7 | |
| E | 36 | 1.1 | |
| F | | 0.3 | 8 |
| G | | 0.07 | |
| H | | 0.0015 | |

In the typical operation of my boiler as above, generating about 1000 pounds of steam per square inch, the boiler feed-water temperature entering at inlet 48 will be 334° F., preheated in exchanger 32 to 485° F. before entering drum 40. The water temperature entering the boiler 70 and in the heat exchange system will be 545° F. The steam from boiler drum 40 is superheated in heater 30 to about 1000° F. The fluidized bed 22 temperature would be 1550° F. using high-sulfur Illinois coal-particle feed, and the exit temperature at 80° being 1440° F., with the inlet temperature at plate 18 at 1540° F., with an overall temperature profile difference throughout the boiler of about 100° F. The flue gas entering the separator 34 has a temperature of 952° F. and the preheated air at inlets 16 and 64 has a temperature of 750° F. These conditions described permit the operation of the boiler at a high thermal efficiency of over 90%.

A study of circulating gas solids mass velocity versus the heat-transfer rate finds that the heat-transfer rate of the upwardly moving particles is increased, while the heat-transfer rate of the downwardly flowing particles in a recirculation system is reduced by virtue of the differences in density occasioned by the downward and upward acceleration forces, respectively. The arch or roof chamber connecting the upper ends of the first upwardly and second downwardly moving chambers also affects the heat-transfer rate due, apparently, to tangential forces and a concentration of solids therein, but overall, a relatively constant heat-transfer rate will be found to be affected throughout my high-solids recirculation system.

Turning now to FIG. 4, there is illustrated another aspect of the present invention, wherein exit 80 of downward chamber 76 is adapted to discharge the exiting transport flow directly into fluidized bed 22. To this end, a curved, extended portion (indicated at 98) is formed at the end of the inner wall 87 of downward chamber 76, with exit 80 thereby defining an exit plane which is vertical.

Accordingly, particulate matter exiting from chamber 76 will be discharged horizontally, as indicated in FIG. 4. The heavier particles will, therefore, fall directly into bed 22, while any lighter particles tending to be carried upwardly by gases rising from bed 22 will be knocked down by the impingement barriers provided by superheater 30 and feed water heater 32.

Advantageously, and according to another aspect of the invention, superheater tubes 30 include a close pitch section (indicated at 30*a*) positioned directly above bed 22 and with the closely spaced heat exchange tubes thereof extending in the direction parallel to distributor plate 20. Thus, the closely spaced tubes will serve as a substantial impingement barrier to the upward flow of particulate matter. In addition, and as here preferably embodied, close pitch heat exchange tubes 30*a* (which are fed by header 56*a* into which tubes 30 feed and which lead to exit header 56) are positioned adjacent exit 80. In this way, the horizontally directed flow from exit 80 will tend to clean any particles which have built up on the impingement barrier.

Also shown in FIG. 4 are alternate means for leading heat exchange fluid to the walls 87 of upward chamber 76. As here embodied, conduit 91 directly couples a mud drum 60 to header 94, thereby obviating cross-over members tapped into the heat exchange tubes 88 of upward conduit 72, as described above.

Figure 5:
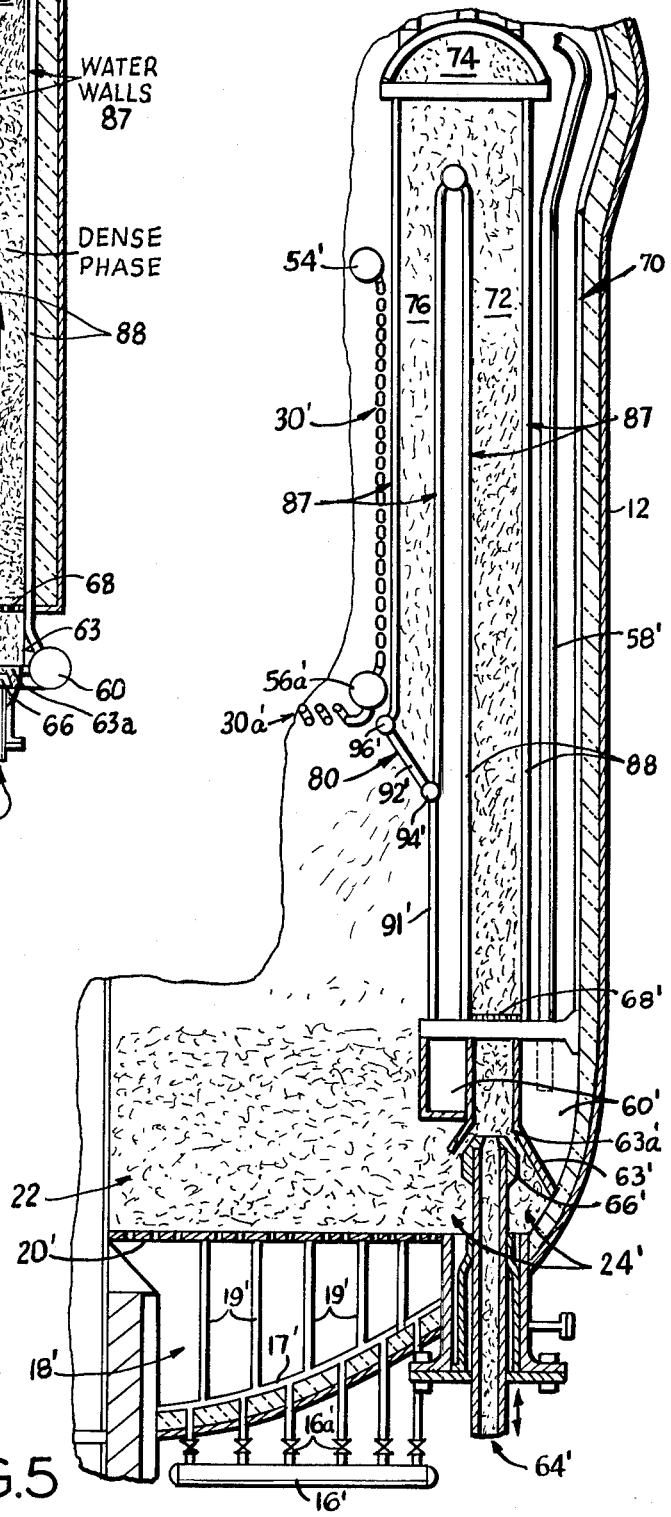
FIG. 5 is a partial elevation view generally similar to that of FIG. 2, showing still another aspect of the invention.

Turning now to FIG. 5, there is illustrated another aspect of the invention, which enables the combustion/-boiler apparatus to be adapted for pressurized use. To this end, wall 12 comprises the wall of a pressurizable vessel into which fuel and other replenishable fluidized bed constituents are introduced by conventional means (not shown). According to the aspect illustrated in FIG. 5, a modified quiescent zone 24' is formed directly under the inlet 63' to upward chamber 72, which is controlled by nozzle valve 66, subtantially as described above. In this way, withdrawal duct 62 is eliminated and the mud drums (indicated at 60') and the heat exchange fluid line (indicated at 58') are located within the vessel for facilitating operation under pressure conditions.

It will be understood that the elements designated with primed characters, although somewhat different in appearance, are substantially similar in function to their counterparts in FIGS. 1–5. However, since the flue gas in pressurized boilers is utilized to run, for example, a gas turbine, the feed water heaters (indicated at 32 in FIGS. 1, 2 and 4) are not positioned above the combustion chamber. Rather, they are located, flow-wise, beyond the device operated by the flue gas in order to obtain the highest efficiency of operation. Similarly, the superheater tubes (indicated at 30' in FIG. 5) are positioned only adjacent the outer wall of downward chamber 76, (for additional heating and preventing overheating of fluid chamber 76), while only the close pitch superheater tubes (indicated generally at 30*a'*) are directly over the combustion bed to provide the impingement barrier.

Operation is essentially the same as the embodiments in FIGS. 1, 2 and 4 except that particulate matter in bed 22 flows directly through the modified quiescent zone 24' and into inlet 63'*a* when air is introduced through inlet 64 and the nozzle valve 66 is oriented to open inlet 63'*a*.

In sum, by my method of operation, a relatively constant heat-transfer rate is obtained in the high-solids circulation system, while adequate control over the operating temperature and capacity is effected through adjustment of the nozzle valve. Thus, control over the system parameters, particularly the capacity, is provided principally by controlling the density of solid particles in the heat exchange chambers, with control points at the fuel inlet to the fluidized bed, the valve controlling flow into heat exchange means, the gas introduced into the heat exchange means, the fuel introduced into the heat exchange means and the gas introduced into the withdrawal duct as well as the fluidizing gas introduced into the fluidized bed.

It will be readily appreciated by those skilled in the art that the invention in its broader aspects is not limited to the specific embodiment herein shown and described. Thus, for example, the inlet end of the heat exchange means, including the nozzle valve, can be located directly in the fluidized bed, with the nozzle valve and air/fuel inlet operable from beneath the bed distribution plate so that particulate matter flows directly into the heat exchange passages.

In addition, it will be understood that the method and apparatus according to the present invention can be applied to any heat transfer mechanism for transferring heat of combustion to a fluid in a generally heat exchange manner, such as in a steam-methane reforming system, an ethylene cracking system, etc. Moreover, the solids circulation system according to the invention may be adapted for use with any exothermic reaction apparatus, such as the reaction of carbon monoxide and hydrogen to hydrocarbons.

Accordingly, it will be understood that variations may be made from the specific embodiments disclosed herein, which are within the scope of the accompanying claims, without departing from the principles of the invention and without sacrificing its chief advantages.

What is claimed is:

1. An improved fluidized bed combustion and heat transfer apparatus having a combustion chamber with a fluidized bed of particulate matter generally supported on a support member adapted to permit introduction of a fluidizing gas medium into the particulate matter and an inlet for introducing a combustible fuel material into the fluidized bed, wherein the improvement comprises:

generally vertically extending heat exchange means generally separated from the fluidized bed, said heat exchange means providing a generally walled heat exchange chamber essentially free of any obstruction to fluid flow therethrough, with heat exchange fluid in the walls of said heat exchange chamber and coupled to apparatus adapted to utilize heated heat exchange fluid;

means for withdrawing a portion of the constituents of the fluidized bed and introducing said withdrawn portion into said heat exchange chamber, generally at the bottom thereof, in a generally fluidized state; and means for reintroducing fluidized material flowing through said heat exchange chamber into the fluidized bed in the combustion chamber generally from the top of said heat exchange means, such that said withdrawn portion of fluidized materials circulates from the fluidized bed, through said heat exchange chamber in said heat exchange means and back into the fluidized bed in said combustion chamber, whereby heat associated with said withdrawn portion of fluidized material flowing through said heat exchange chamber is transferred to said heat exchange fluid through the walls of said heat exchange chamber.

2. An improved apparatus according to claim 1, wherein said withdrawal means includes:

first inlet means in said heat exchange means, generally at the bottom of said heat exchange chamber, the size of said first inlet means being controllable for controlling the rate of flow of said portion of fluidized bed constituents into said heat exchange chamber; and means for introducing a desired gas into said heat exchange chamber, generally at the bottom thereof, for controlling the density of said portion of fluidized bed constituents flowing in said heat exchange chamber.

3. An improved apparatus according to claim 2, wherein said gas introduction means is adjustable for enabling control of the amount of gas introduced into said heat exchange chamber.

4. An improved apparatus according to claim 3, wherein the gas introduced through said gas introduction means includes a combustible component, such that uncombusted fuel included in said portion of fluidized bed constituents can be combusted in said heat exchange chamber for increasing the amount of heat transferred to said heat exchange fluid.

5. An improved apparatus according to claim 4, which further includes means for introducing additional fuel into said heat exchange chamber, generally at the bottom thereof.

6. An improved apparatus according to claim 5, wherein said additional fuel introduction means comprises said gas introduction means, such that the gas and the additional fuel can be introduced essentially simultaneously into said heat exchange chamber.

7. An improved apparatus according to claim 6, wherein said first inlet means is controlled by nozzle valve means adapted to provide said gas and additional fuel introduction means.

8. An improved apparatus according to claim 7, wherein said heat exchange means comprises:

upstanding continuous heat exchange panel means defining a first vertically extending heat exchange chamber adapted to permit essentially unobstructed flow of said portion of fluidized bed constituents therethrough.

9. An improved apparatus according to claim 8, wherein said first heat exchange chamber includes heat exchange partition panels dividing said chamber into at least two heat exchange passages, each said heat exchange passage being in flow communication with at least some of said portion of the fluidized bed constituents.

10. An improved apparatus according to claim 8, wherein said reintroduction means comprises a continuation of said heat exchange panel means defining a second heat exchange chamber coupled to and extending essentially parallel to said first heat exchange chamber, said second heat exchange chamber having an exit adapted to discharge said portion of the fluidized bed flowing through said heat exchange means back into the fluidized bed.

11. An improved apparatus according to claim 1, wherein the cross-sectional area of said heat exchange chamber is proportioned such that the temperature profile of said portion of the fluidized bed constituents flowing through said heat exchange chamber is essentially uniform across the flow path at essentially any vertical position in the heat exchange chamber.

12. An improved apparatus according to claim 1, wherein said withdrawal means comprises:

a generally quiescent zone in said combustion chamber, generally adjacent the fluidized bed support member, said quiescent zone being generally undistrubed directly by the fluidizing gas medium acting on the fluidized bed;

flow access means for providing access for fluidized bed constituents to flow into said heat exchange means;

first inlet means in said heat exchange means, generally at the bottom of said heat exchange chamber, the size of said first inlet means being controllable for controlling the rate of flow of said portion of fluidized bed constituents into said heat exchange chamber; and means for introducing a desired gas into said heat exchange chamber, generally at the bottom thereof, for controlling the density of said portion of fluidized bed constituents flowing in said heat exchange chamber.

13. An improved apparatus according to claim 12, wherein said gas introduction means is adjustable for enabling control of the amount of gas introduced into said heat exchange chamber.

14. An improved apparatus according to claim 13, wherein the gas introduced through said gas introduction means includes a combustible component, such that uncombusted fuel included in said portion of the fluidized bed constituents can be combusted in said heat exchange chamber for increasing the amount of heat transferred therein.

15. An improved apparatus according to claim 14, wherein said flow access means comprises an essentially open space between said quiescent zone and said first inlet means, such that fluidized matter situated within said quiescent zone can flow directly into said heat exchange chamber.

16. An improved apparatus according to claim 14, wherein said flow access means comprises a withdrawal duct providing flow communication between said quiescent zone and said first inlet means of said heat exchange chamber.

17. An improved apparatus according to claim 16, wherein said first inlet means is controlled by nozzle valve means extending through said withdrawal duct and adapted both to control flow through said first inlet and to provide said gas introduction means.

18. An improved apparatus according to claim 17, wherein said nozzle valve means is further adapted to permit introduction of additional fuel into said heat exchange chamber for combustion therein.

19. An improved apparatus according to claim 18, wherein said heat exchange chamber is partitioned to define at least two heat exchange passages therein, each said heat exchange passage having inlet means and being essentially free of any obstruction to fluid flow therethrough and which further includes a said withdrawal duct for each said heat exchange passage, such that each said withdrawal duct provides flow communication for some of said portion of fluidized bed constituents to its corresponding heat exchange passage.

20. An improved apparatus according to claim 19, wherein said reintroduction means comprises an additional section of said heat exchange means, extending parallel thereto and coupled at one end to the top of said heat exchange means, the other end of said additional section opening generally towards the fluidized bed, such that fluidized matter circulated from said quiescent zone into said heat exchange passages will flow through the additional heat exchange passages in said additional heat exchange section and generally back to the fluidized bed.

21. An improved apparatus according to claim 20, wherein the cross-sectional area of each said heat exchange passage is proportioned such that the temperature profile of fluidized bed constituents flowing through each said heat exchange passage is essentially uniform across the flow path at essentially any vertical position therein.

22. An improved apparatus according to claim 21, wherein each said heat exchange passage is essentially rectangular in cross-section, having a thickness of between about one-half foot and about four feet.

23. An improved apparatus according to claim 1, which further includes additional heat exchange means positioned over the fluidized bed for heating heat exchange fluid contained therein and for providing an impingement barrier against particulate matter tending to escape with flue gases.

24. An improved apparatus according to claim 23, wherein said additional heat exchange means includes at least one layer of close pitch heat exchange tubes, positioned above the fluidized bed.

25. An improved apparatus according to claim 24, wherein said additional heat exchange means further includes a heater for heating heat exchange fluid circulating in said heat exchange means.

26. An improved apparatus according to claim 25, wherein said additional heat exchange means further include a superheater for heating heat exchange fluid which has been heated in said heat exchange means.

27. An improved apparatus according to claim 12, wherein at least portions of the support member for the fluidized bed is sloped towards said quiescent zone.

28. An improved apparatus according to claim 1, wherein said apparatus is a fluidized bed combustion/-boiler apparatus adapted to provide superheated steam.

29. A fluidized bed combustion boiler for transferring heat to a heat exchange fluid, which comprises:

a boiler housing having a combustion chamber therein;

inlet means in said housing for introducing combustible fuel into the combustion chamber;

fluidizing gas introduction means for introducing a fluidizing gas into the combustion chamber for fluidizing the combustible fuel and other desired bed constituents to provide a combustible fluidized bed of particulate matter in the combustion chamber;

generally vertically extending heat exchange means generally separated from said fluidized combustion bed, said heat exchange means having an inlet generally at the bottom thereof and being essentially free of any obstructions to fluid flow therethrough and said heat exchange means adapted to provide a heat exchange fluid in heat exchange relation with fluid flow therethrough and in fluid communication with apparatus adapted to utilize heated heat exchange fluid;

withdrawal means in fluid communication with the fluidized bed, said withdrawal means being adapted to enable flow transfer of a portion of fluidized bed constituents from the fluidized bed into said heat exchange means through the inlet thereof; and means for reintroducing the fluidized bed constituents flowing through said heat exchange means back into the fluidized bed, such that a solids heat transfer circulation is set up by said portion of fluidized bed constituents flowing from the fluidized combustion bed through said heat exchange means via said withdrawal means and back into the fluidized combustion bed, heat associated with the fluidized bed constituents and gases flowing through said heat exchange means being transferred to heat exchange fluid in said heat exchange means for utilization in the heated fluid utilization system.

30. A fluidized bed combustion device according to claim 29, wherein the inlet to said heat exchange means is controllable to control the rate of flow of said portion of fluidized bed constituents into said heat exchange means, and wherein said withdrawal means include:

a quiescent area in said combustion chamber, essentially undistrubed by fluidizing gas from said fluidizing gas introduction means;

nozzle valve means at the inlet of said heat exchange means, said nozzle valve means adapted to control fflow of said portion of fluidized bed constituents through said inlet of said heat exchange means;

flow access means for enabling fluidized bed constituents and gas to flow from said quiescent zone into said heat exchange inlet; and gas introduction means for introducing a desired gas into said heat exchange means, generally at the bottom of said heat exchange means, for controlling the density of said portion of fluidized bed constituents flowing into said heat exchange means.

31. In a fluidized bed boiler which includes a boiler vessel containing a fluidized bed of particulate material in a combustion chamber, a high-solids circulating system, comprising:

means for withdrawing a portion of the fluidized bed;

a first vertically disposed heat exchange chamber having a bottom inlet coupled to said withdrawal means for receiving the withdrawn portion of fluidized bed material therefrom, said first heat exchange chamber being essentially free of any obstruction to fluid flow therethrough;

means for introducing a gas upwardly in said first heat exchange chamber and at the bottom portion thereof to enable upward transport flow of the withdrawn fluidized material in said first heat exchange chamber;

means for discharging the withdrawn fluidized material from the top of said first heat exchange chamber into the fluidized bed of the boiler;

the cross-sectional area of said first heat exchange chamber being proportioned such that the temperature profile of upward transport flow of said withdrawn fluidized material is substantially uniform across the cross section of said flow at any vertical position in said first heat exchange chamber.

32. The system according to claim 31, wherein the first heat exchange chamber includes a plurality of heat exchange passages separated by heat exchange partition walls in said first chamber, each said heat exchange passage coupled to said withdrawal means for permitting substantially unobstructed flow through each said passage, the thickness of each said passage being between about one-half foot to about four feet.

33. The system of claim 31, wherein said gas introduction means includes an upwardly positioned adjustable nozzle valve directly below the bottom inlet of said first heat exchange chamber.

34. The system of claim 31, wherein the withdrawal means comprises a generally U-shaped duct, one end of which is in direct flow communication with the bottom of the fluidized bed of the boiler, and the other end of which is in direct flow communication with the bottom inlet of the first chamber, and wherein the gas introduction means includes an upwardly positioned nozzle in said other end, and which further includes second gas introduction means in the duct for introducing gas tangentially toward said other end for assisting to control the flow of the fluidized material from the fluidized bed toward said other end of the duct.

35. The system of claim 31, which further includes impingement means positioned over the fluidized bed to prevent the upward movement and escape of fine particles from the discharge means of the circulation system.

36. The system of claim 35, which includes gas-solids separator means to collect fine particles moving upwardly from the discharge means, and means to return the collected solids particulate matter directly into the fluidized bed.

37. A method for controlling capacity in a fluidized bed combustion boiler, which comprises the steps of controlling the density of transport flow circulation of particulate matter from the fluidized bed through heat exchange means and back to the fluidized bed essentially without changing the density of the fluidized bed, said step of controlling density including the steps of introducing gas at the bottom of the heat exchange means which extends generally vertically for generally vertical flow of said particulate matter therethrough and providing flow communication between the fluidized bed and the bottom of the heat exchange means for generating a density gradient in the heat exchange means, thereby to provide a pressure differential through the heat exchange means.

38. An improved method of combusting fuel for and transferring heat generated during fluidized bed combustion, the heat transfer occurring generally within heat exchange means, wherein the improvement comprises:

introducing a gas into the chamber of the heat exchange means generally at the bottom thereof to cause a portion of the constitutents of a fluidized combustion bed to flow upwardly in heat exchange relation through the chamber of the heat exchange means, the chamber being free of any obstructions to said flow; and reintroducing said portion after reaching the top of the heat exchange means generally back into the fluidized bed, such that the heat associated with said portion of fluidized bed constitutents is transferred to heat exchange fluid of said heat exchange means.

39. An improved method of combusting fuel for and transferring heat generated during fluidized bed combustion, the heat transfer occurring generally within heat exchange means, wherein the improvement comprises:

causing a portion of the constitutents of a fluidized combustion bed to flow upwardly in heat exchange relation through the chamber of the heat exchange means, the chamber being essentially free of any obstructions to said flow; and reintroducing said portion after reaching the top of the heat exchange means generally back into the fluidized bed by passing the portion of fluidized bed constitutents downwards through a generally parallel extension of the heat exchange means and discharging the fluidized bed constitutents into the fluidized combustion bed, such that the heat associated with said portion of fluidized bed constitutents is transferred to heat exchange fluid of said heat exchange means.

40. An improved method according to claim 38, wherein said flow causing step further includes controlling the size of the inlet to the heat exchange chamber.

41. An improved method according to claim 40, wherein said gas is at least partially combustible, such that unburned fuel included in said portion of fluidized bed constituents can be burned in the heat exchange chamber while heat generated thereby can be transferred to the heat exchange fluid of the heat exchange means.

42. An improved method according to claim 41, which further includes the step of introducing additional fuel into the heat exchange chamber, generally at the bottom thereof, to enable combustion of the additional fuel within the heat exchange chamber for increasing the amount of heat transferred to the heat exchange fluid.

43. An improved method according to claim 42, wherein the gas and the additional fuel are introduced at substantially the same location in said heat exchange means.

44. An improved method according to claim 42, wherein the additional fuel includes finely ground coal particles up to about 100 microns in size.

45. A method according to claim 38 or 39, which further includes the step of proportioning the cross-sectional area of the heat exchange chamber to enable an essentially uniform temperature across the flow path of the fluidized bed constituents flowing at each point in the heat exchange chamber.

46. A method of combusting fuel in a fluidized bed bed combustion boiler, wherein fuel and an oxygen-containing gas are combusted in a fluidized bed containing particulate material, to provide heat to a heat exchange fluid, which comprises:

transporting a portion of the fluidized bed particulate material in a generally vertical, upward, transport-flow path free essentially of any transfer-flow obstruction therein, while combusting fuel in the transport-flow path, and maintaining the combustion in a heat exchange relationship in such upward transport flow with a heat exchange fluid, and maintaining in such transport-flow path a substantially uniform combustion-temperature profile across the flow path; and discharging the fluidized bed particulate material, after such upward flow, into the fluidized bed of the boiler.

47. The method of claim 46, wherein the combustion-temperature ranges from about 1500° F. to about 1800° F.

48. The method of claim 46, which includes collecting finely-divided particulate material flowing upwardly, after the discharging and returning of the collected particulate material, to the fluidized bed.

49. The method of claim 48, which further includes preheating fuel introduced into the fluidized bed by returning the collected particulate material to the fluidized bed adjacent the fuel inlet to said bed.

50. The method of claim 46, which includes transporting the particulate material upwardly in the transport flow path by passing an oxygen-containing gas upwardly into the inlet of a vertically disposed first chamber which defines the transport-flow path.

51. The method of claim 50, which includes heating the heat exchange fluid, which fluid is disposed in the walls of the first chamber surrounding the flow-transfer path.

52. The method of claim 46, which includes withdrawing a portion of the fluidized bed into a generally U-shaped withdrawal duct at the one end thereof by passing an oxygen-containing gas tangentially into the duct at a pressure greater than the pressure in the fluidized bed, and discharging the withdrawn fluidized particulate material into the lower inlet of the transport-flow path.

53. The method of claim 46, which includes introducing fuel upwardly in the transport-flow path.

54. The method of claim 46, wherein the temperature across the transport flow path, at any point therealong, does not vary more than about 20° F.

55. The method of claim 44, which includes circulating the particulate material of the fluidized bed through such transport-flow path in a time of from 5 to 120 seconds.

* * * * *